US005240371A

United States Patent [19]

Belomestnov

[11] Patent Number: 5,240,371

[45] Date of Patent: Aug. 31, 1993

[54] MULTIPLE DISC FAN WITH ROTATABLE CASING

[76] Inventor: Petr I. Belomestnov, Morskoi prospekt, 64, kv. 10, Novosibirsk, U.S.S.R.

[21] Appl. No.: 760,446

[22] Filed: Aug. 16, 1991

Related U.S. Application Data

[60] Continuation of PCT/SU/00268 filed Oct. 16, 1989.

[51] Int. Cl.[5] ..... F04D 5/00

[52] U.S. Cl. ..... 415/53.1; 415/90; 415/127; 415/203

[58] Field of Search ..... 415/52.1, 53.1, 90, 415/126, 127, 208.1, 203, 206

[56] References Cited

U.S. PATENT DOCUMENTS

| | | | |
|---|---|---|---|
| 2,339,575 | 1/1944 | Lee | 415/90 X |
| 2,632,598 | 3/1953 | Wale, Jr. | 415/90 X |
| 3,037,457 | 6/1962 | Sternlight | 415/90 |
| 3,147,909 | 9/1964 | Novitsky | 415/126 X |
| 3,275,223 | 9/1966 | Fowell | 415/53.1 |
| 3,375,539 | 4/1968 | Loepsinger | 415/127 X |
| 3,467,302 | 9/1969 | Wilson | 415/206 X |
| 3,712,754 | 1/1973 | Brouwer | 415/90 |
| 3,751,908 | 8/1973 | Colwell et al. | 415/90 X |
| 3,930,745 | 1/1976 | Gassie | 415/141 |
| 4,856,968 | 8/1989 | Armbruster | 415/126 X |

FOREIGN PATENT DOCUMENTS

| | | | |
|---|---|---|---|
| 452393 | 3/1913 | France | 415/90 |
| 985443 | 12/1982 | U.S.S.R. . | |
| 985444 | 12/1982 | U.S.S.R. | 415/90 |
| 89/07202 | 8/1989 | World Int. Prop. O. . | |

*Primary Examiner*—Edward K. Look
*Assistant Examiner*—Todd Mattingly
*Attorney, Agent, or Firm*—Keck, Mahin & Cate

[57] ABSTRACT

A fan has a casing (1) having walls defining a flow duct which accommodates a multiple-disc rotor (1) mounted for rotation about the axis (3) thereof. The flow duct also accommodates baffles provided on opposite sides of the rotor (1) to extend along its axis (3). According to the invention, the casing (7) is mounted for rotation about the axis (3) of the rotor (1). The fan is useful for controlling air-exchange in living space or industrial production space.

1 Claim, 1 Drawing Sheet

MULTIPLE DISC FAN WITH ROTATABLE CASING

RELATED APPLICATION

This application is a continuation of PCT/SU/00268, filed Oct. 16, 1989 entitled "Fan".

TECHNICAL FIELD

The invention relates to devices for building up gauge pressure of air or other gas for moving them, and more particularly, the invention is concerned with fans.

BACKGROUND ART

Widely known in the art is an axial fan having an electric motor with a shaft carrying a vane impeller. The fan is provided with a special device for regularly rotating the fan casing. During operation this fan generates a perceptible aerodynamic noise which is caused by separation of flow moving around the vanes of the rotating impeller which is characteristic of all air blowing machines of the vane type. The vanes of the operating fan can also be a cause of injuries due to a careless approach to the fan impeller.

In addition, the fan can create a directional turbulent flow in one direction, i.e. the fan has a predetermined limited space coverage which can only insignificantly be enlarged by regularly rotating the electric motor casing. The directional character of the turbulent flow results in overcooling of certain areas of a human body which is within the closest range of the fan.

Most similar to the invention is a fan (PCT/SU 88/00025), comprising a casing having walls defining a flow duct. The flow duct accommodates a multiple-disc rotor in the form of a plurality of coaxial discs connected to one another in spaced relation to each other. The rotor is connected to a drive shaft, e.g. to an electric motor shaft and is mounted for rotation about its axis. In addition, baffles provided in the flow duct are positioned on the two opposite sides of the rotor to extend along the axis thereof. The baffles define suction and delivery areas with the casing walls. This fan, owing to viscous friction forces in the boundary zones adjacent to the surfaces of the discs of the rotating rotor generates two oppositely directed air streams. The absence of large-scale separated and vortical flows in the working zone which are characteristic of vane-type machines in such a fan ensures a low level of aerodynamic noise generated by the fan. The fan construction ensures a closed accommodation of the impeller so as to rule out any inadvertent touching of the discs and the rotating rotor. The character of energy transmission to the air in such a fan causes generation of outlet streams in the laminary mode within a large range of rotor speeds owing to low hydraulic diameters of flow passages which are in the form of narrow slits between the adjacent discs. Laminary air flows can somewhat lower the level of overcooling of parts of a human body within the range of the fan and reduce the incidence of colds. In addition, the provision of two pairs of suction and delivery areas which are located adjacent to each other and positioned on opposite sides of the rotor in the casing reduces the directional character of the escaping streams owing to air overflow from the delivery areas into the adjacent suction areas thus contributing to a diffusion of flow and a decrease in harmful action upon a human body.

However, a strict flow of two parallel air streams in the opposite direction, with the cross-sectional size of the streams being about equal to the size of passages of the flow duct, results in directed streams so that comfort conditions for a human being in a room that would feature a moderate air exchange distributed over the whole room space cannot be provided to ensure a favourable and safe environment for a human being, especially at high temperature and humidity.

DISCLOSURE OF THE INVENTION

The invention is based on the problem of providing a fan of such a construction which would ensure free rotation of the fan casing about the axis of the rotor due to aerodynamic forces ensuring an air exchange distributed over the whole room space.

The problem is solved by a fan having a casing with walls defining a flow duct accommodating a multiple-disc rotor connected to a drive shaft for rotation about its axis, and baffles positioned on the opposite sides of the rotor to extend along the axis thereof and defining suction and delivery areas with the casing walls, according to the invention, the casing is mounted for rotation about the axis of the rotor.

Owing to the provision of the casing rotatable about the axis of the rotor in the fan according to the invention, the casing is caused to rotate by aerodynamic forces so as to generate air streams diffused in space and to provide for a favourable air exchange over the whole space of a room thus creating comfort and safe conditions for human health.

BRIEF DESCRIPTION OF THE DRAWINGS

The invention will now be described with reference to a specific embodiment thereof illustrated in the accompanying drawings, in which.

BEST MODE TO CARRY OUT THE INVENTION

Figure 1:
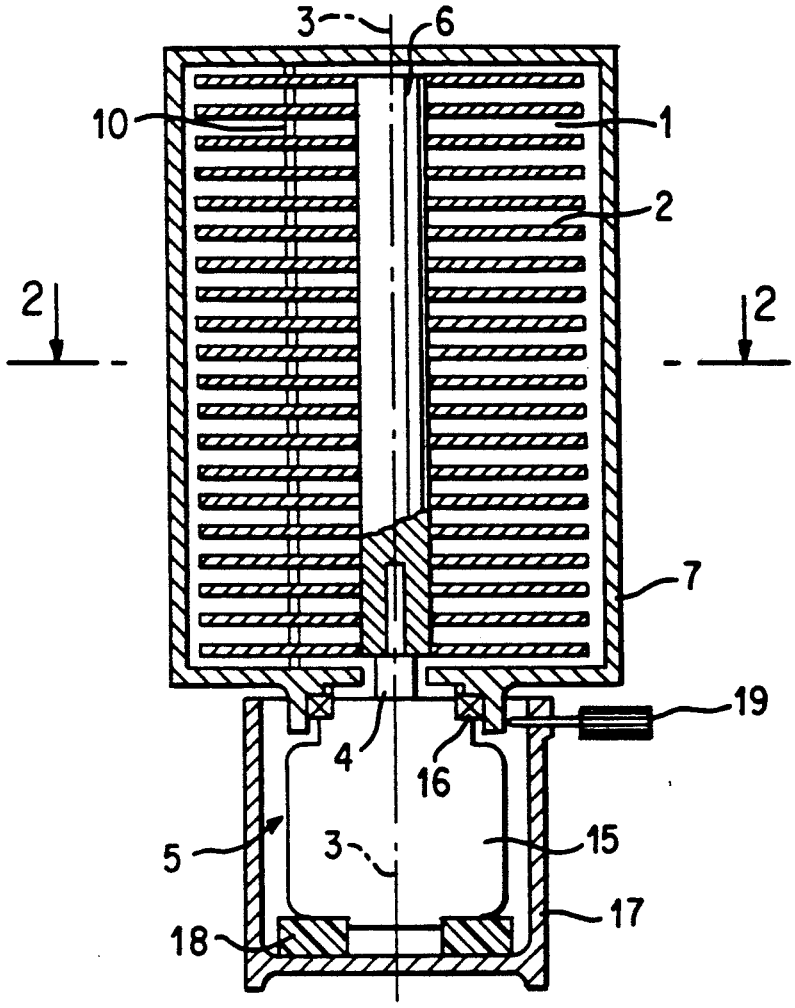
FIG. 1 is a general view, in longitudinal section, of a fan according to the invention.
Figure 2:
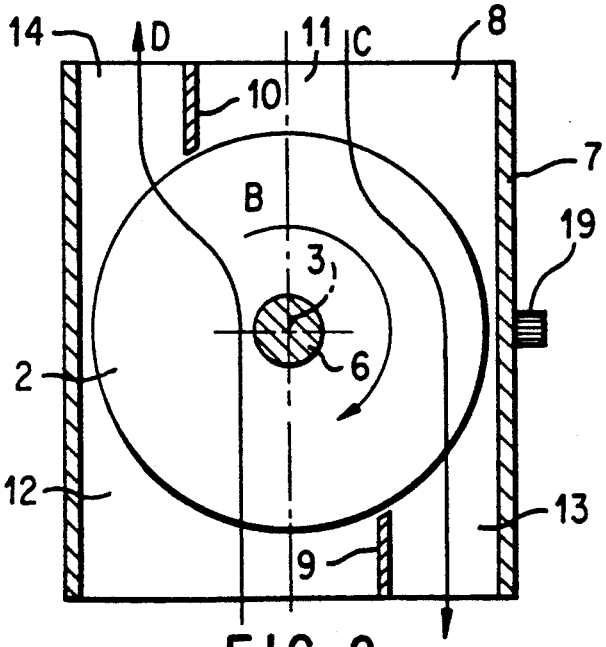
FIG. 2 is a sectional view taken along line in FIG. 1.

A fan shown in FIGS. 1, 2 comprises a multiple-disc rotor 1 in the form of a plurality of discs 2 having an axis 3 and connected to a drive shaft 4. A drive is generally in the form of an electric motor 5 as shown in this embodiment.

The discs 2 of the rotor 1 are connected to one another in a spaced relation to each other on a shaft 6 which in this embodiment is rigidly secured to the shaft 4 of the electric motor 5. The shaft 6 of the rotor 1 can also be coupled to the shaft 4 of the electric motor 5, e.g. by means of a clutch. The rotor 1 is mounted in a casing 7 having its walls defining a flow duct 8 (FIG. 2) extending at right angle to the axis 3 of the rotor 1. In this embodiment the flow duct 8 is of a rectangular cross-sectional configuration. A pair of baffles 9, 10 provided on the two opposite sides of the rotor 1 are secured in the flow duct 8 to extend along the axis 3 of the rotor 1. The length of the baffles 9, 10 (FIGS. 1, 2) is equal to the height of the flow duct 8 and their width is about equal to a distance from the opening of the flow duct 8 to the discs 2 of the rotor 1.

The baffles 9, 10 divide the interior space of the flow duct 8 on either side of the rotor 1 and define with the walls of the casing 7 suction areas 11, 12 and delivery areas 13, 14, respectively.

The casing 7 (FIG. 1) is journalled on a stator 15 of the electric motor 5 by means of a bearing 16 for rotation.

The electric motor 5 is mounted on a pedestal 17 by means of shock-absorbers 18.

A friction brake 19 is provided in the pedestal 17.

The fan shown in FIGS. 1, 2 functions in the following manner. During rotation of the multiple-disc rotor 1 secured at the end of the shaft 4 of the electric motor 5 in the direction shown by arrow B (FIG. 2) air in the fan casing 7 is caused to move in two opposite directions owing to viscous friction forces generated in boundary layers adjacent to the disc surfaces so as to create two opposite streams shown by arrows C and D. Air moves in one direction from the suction area 11 defined by the wall of the casing 7 and baffle 10 into the delivery area 13 defined by the same wall of the casing 7 and the baffle 9. Air moves in the opposite direction from the suction area 12 defined by the wall of the casing 7 and the baffle 9, moves through the interdisc areas of the rotor 1 into the delivery area 14 defined by the same wall of the casing 7 and the baffle 10. The opposite air streams generated in the casing 7 move along the surfaces of the walls of the casing 7 and surfaces of the baffles 9 and 10 facing towards the delivery areas 13 and 14 and create, owing to viscous friction forces, a couple of forces applied to the casing 7 in the direction of rotation of the rotor 1.

The air streams entering the suction areas 11 and 12 also cooperate with the surfaces of the baffles 9 and 10 facing towards these areas so as to give rise to a couple of forces applied to the casing 7 in a direction opposite to the direction of rotation of the rotor 1. Flow velocities in the suction zones 11, 12 are lower than those in the delivery areas 13, 14 because of the continuity of flows in the suction areas 11 and 12 which have larger cross-sectional areas in comparison with those of the delivery areas 13, 14. In addition, the surface areas of the baffles 9 and 10 along which these streams flow are substantially smaller than the total surface area of the opposite sides of the baffles 9, 10 and walls of the casing 7. For these reasons, the resulting moment applied to the casing 7 will act in the direction of rotation of the rotor 1, and the casing 7 will be caused to turn on the bearing 16 relative to the stator 15 of the electric motor 5 so as to rotate in this direction. Owing to a continuous rotation of the casing 7 of the fan, streams escaping therefrom will diffuse in space. During rotation of the rotor 1 and casing 7, the shock-absorbers 18 by means of which the electric motor 5 is mounted on the pedestal 17 take up vibrations generated because of an eventual unbalance of the rotor 1 to lower the level of generated noise.

A test trial of a pilot sample of a desk fan made in accordance with the invention showed that the continuous rotation of the casing 7 caused by interaction of opposite air flows generated by rotation of the multiple-disc rotor 1 and surfaces of the elements of the casing 7 washed by these streams ensures a substantial diffusion of the outlet air streams which are diffused in the ambient space. The fan provides comfortable conditions, and its effect is like the effect of a hand fan. The noise is practically imperceptible. The use of the friction brake 19 allows the casing speed to be controlled so as to make a choice as to the most favourable mode of ventilation. In addition, the device is capable of automatically increasing the casing speed for any mode of operation in case hands or other parts of a human body move close to one or both delivery areas and only for a time such barriers remain in the immediate vicinity of the outlet ports of the fan. This effect, which is caused by an increase in the overall pressure in the delivery areas when a barrier appears close to the air outlet ports, hence in case of an increase in viscous friction forces of the streams adjacent to the surfaces of the casing elements along which they move which result in an increase in torque applied to the casing, accelerate rotation of the casing so as to provide only for a short-time exposure of parts of the body inadvertently moved close to the shortest fan range to air streams thus ruling out over-cooling.

INDUSTRIAL APPLICABILITY

This fan can be used to most advantage for regulation of air exchange in rooms to ensure a favourable environment for a human being.

The fan can also be used for maintaining environmental conditions necessary to provide technological processes within production spaces.

I claim:

1. A fan comprising a casing (7) having walls defining a flow duct (8) accommodating a multiple-disc rotor (1) connected to a drive shaft (4) for rotation about an axis (3) of said rotor, and baffles (9, 10) positioned on opposite sides of the rotor (1) parallel to the axis (3) thereof and defining, together with the casing walls, suction areas (11, 12) and delivery areas (13, 14), wherein the casing (7) is mounted for rotation about the axis (3) of the rotor (1) in the direction of rotation of the rotor during operation of the fan, said rotation of the casing being caused by aerodynamic forces of air flowing through the fan from opposite sides of said casing, via one of said suction areas and delivery areas, successively.

* * * * *